United States Patent [19]

Kurakake et al.

[11] Patent Number: 4,890,100

[45] Date of Patent: Dec. 26, 1989

[54] PICTURE PROCESSING APPARATUS INCLUDING A DUAL PORT MEMORY

[75] Inventors: Mitsuo Kurakake; Shoichi Otsuka, both of Hino; Yutaka Muraoka, Hachioji, all of Japan

[73] Assignee: Fanuc Ltd., Minamitsuru, Japan

[21] Appl. No.: 102,562

[22] PCT Filed: Apr. 17, 1987

[86] PCT No.: PCT/JP87/00245

§ 371 Date: Sep. 1, 1987

§ 102(e) Date: Sep. 1, 1987

[87] PCT Pub. No.: WO87/06743

PCT Pub. Date: Nov. 5, 1987

[30] Foreign Application Priority Data

Apr. 25, 1986 [JP] Japan ..... 61-095969

[51] Int. Cl.[4] ..... G09G 1/00

[52] U.S. Cl. ..... 340/799; 340/798; 340/703

[58] Field of Search ..... 340/701, 703, 744, 747, 340/750, 789, 798, 799; 364/518, 521

[56] References Cited

U.S. PATENT DOCUMENTS 4,562,435 12/1985 McDonough et al. ..... 340/798
4,646,078 2/1987 Knierim et al. ..... 340/747
4,731,742 3/1988 Nishi et al. ..... 340/747

*Primary Examiner*—David K. Moore
*Assistant Examiner*—Jeffery A. Brier
*Attorney, Agent, or Firm*—Staas & Halsey

[57] ABSTRACT

The present invention is directed to a picture processing apparatus for painting a picture memory of a CRT display unit or similar apparatus by paint data. In accordance with this picture processing apparatus, a dual-port memory (4) is used as a frame buffer for storing picture information. In order to store paint information in a memory cell array (7), the information is internally transferred from predetermined storage circuit (9) via a data register (8) having a serial input function. The number of times the dual-port memory (4) is accessed from the processor (1) is greatly reduced so that the burden on the processor (1) can be alleviated. It is also possible to shorten the time required for the paint information to be stored in the memory cell array (7).

19 Claims, 4 Drawing Sheets

3 RANDOM PORT BUS
7 MEMORY CELL ARRAY
5 RANDOM-ACCESS BLOCK
4 DUAL-PORT MEMORY
6 SERIAL-ACCESS BLOCK
20
DATA REGISTER
8
21
9 STORAGE MEANS
23
SERIAL PORT BUS 22
STK
25
24 DATA BUS
2 SYSTEM BUS
PROCESSOR
1

DUAL-PORT MEMORY 4
DIGIT ADDRESS BUFFER
11
CADR
DIGIT SELECT BUFFER
13
MEMORY CELL ARRAY
7
256
20
WORD SELECT RECORDER
12
10
RADR
WORD ADDRESS BUFFER
256
DATA REGISTER
8
21
22
23
CAS
RAS
ADR
WE
DT
RANDOM PORT-BUS
3

5 RANDOM-ACCESS BLOCK
4 DUAL-PORT MEMORY
6 SERIAL-ACCESS BLOCK
7 MEMORY CELL ARRAY
3 RANDOM PORT BUS
8
DATA REGISTER
20
21
92
SECOND STORAGE MEANS
91 FIRST STORAGE MEANS
24 DATA BUS
SERIAL PORT BUS 22
23
251
STK 2
STK 1
252
2 SYSTEM BUS
PROCESSOR
1

PICTURE PROCESSING APPARATUS INCLUDING A DUAL PORT MEMORY

TECHNICAL FIELD

This invention relates a picture processing apparatus in which a frame memory of a CRT display unit can be painted by any painting data such as luminance information and color discrimination information.

BACKGROUND ART

In order to paint a frame buffer of a picture display unit uniformly with any data such as luminance data and color data, prescribed picture processing is required. Conventionally, in control for such picture processing, a single-access port or double-access port is used in order to connect the frame memory with a processor for control.

If a single-port memory is used as a frame buffer, the operation for painting the frame buffer, namely the writing of data into the frame buffer, is performed from a single random port. If a dual-port memory is used as a frame buffer, a serial-access port is used to read data out of the memory cell array. However, when a data register for serial access of a dual port memory is equipped only with a data output function, the writing of input data, such as paint information, into the memory cell array is carried out from a random port.

In a case where the single-port memory is used as the frame buffer, or in a case where the data register possesses solely an output function even if the dual-port memory is used as the frame buffer, the paint information from a processor must be written through a random port each time for every pixel when the frame buffer is painted with the predetermined information. Let T represent the time needed to write paint information in one specific row and column of the frame memory. In order to write paint information into an entire frame buffer composed of, e.g., 256×256 pixels, the processor must access the frame buffer 256×256 times, so that a time equivalent to 256×256 ×T is required in order to write all the paint information. As a result, painting is very slow and the processor is subjected to a very heavy burden required for paint.

The present invention seeks to eliminate the foregoing problems of the conventional picture processing apparatus and its object is to provide a picture processing apparatus in which the burden on the processor can be lightened and paint information can be stored in the frame buffer at high speed.

SUMMARY OF THE INVENTION

The present invention provides a picture processing apparatus having a picture memory comprising a dual-port memory connected to a processor via a serial port and random port, including a memory cell array which is randomly accessed by the processor via the random port and in which predetermined pixel information is stored, a data register, which has a serial input function, accessed via the serial port and adapted to transfer predetermined paint information to the memory cell array, and storage means accessed by the processor for storing paint information transferred to the data register.

In the present invention, the dual-port memory is used as the frame buffer, paint information stored in the storage means is transferred serially to the data register of the dual-port memory, the paint information supplied to the data register is transferred internally to the memory cell array of the dual-port memory one row at a time, and the paint information is written into the frame buffer at high speed.

DESCRIPTION OF THE PREFERRED EMBODIMENTS

Embodiments of the invention will now be described in detail with reference to the drawings.

Figure 1:
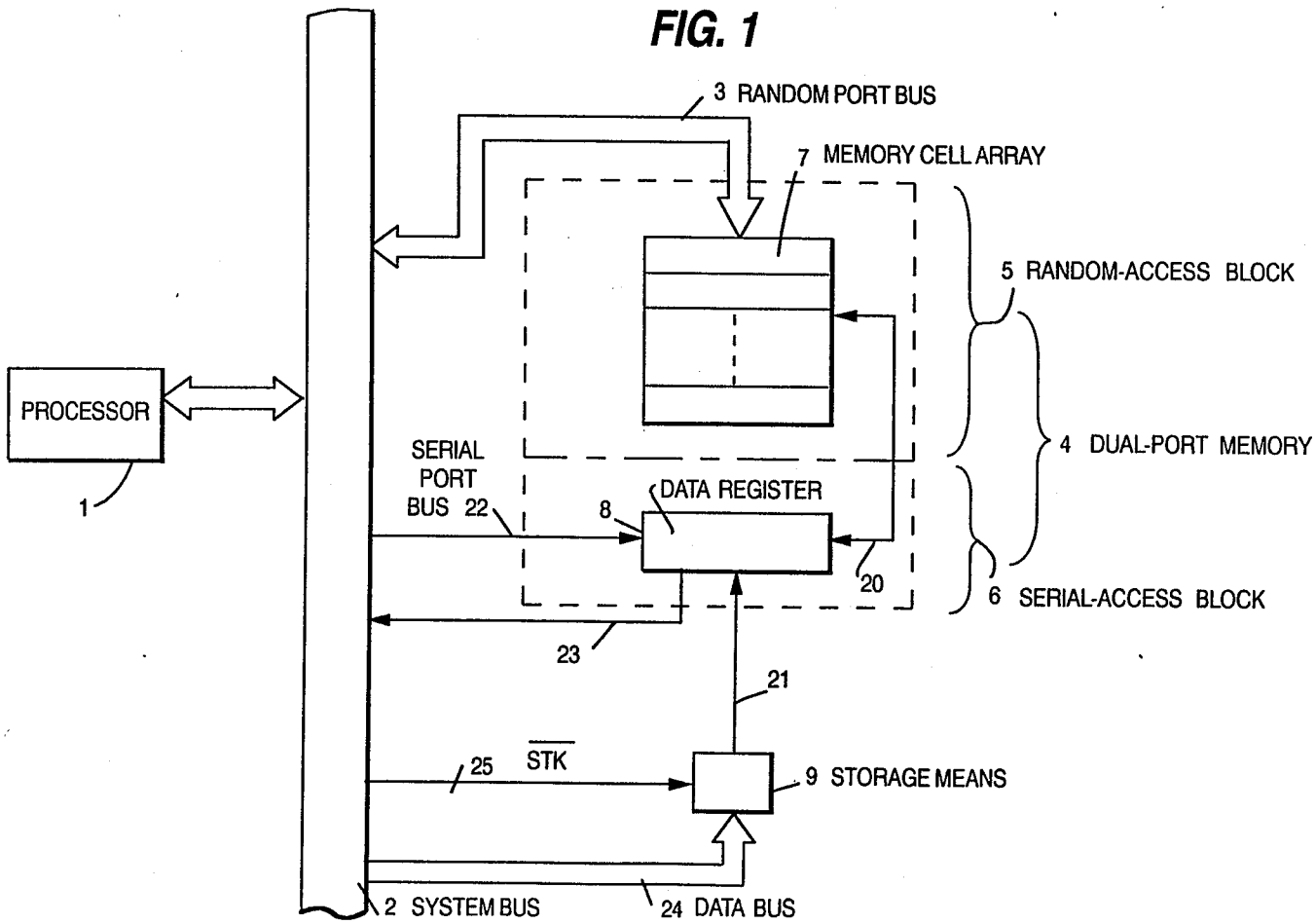
FIG. 1 is a block diagram, of a first embodiment of a picture processing apparatus according to the invention.
Figure 2:
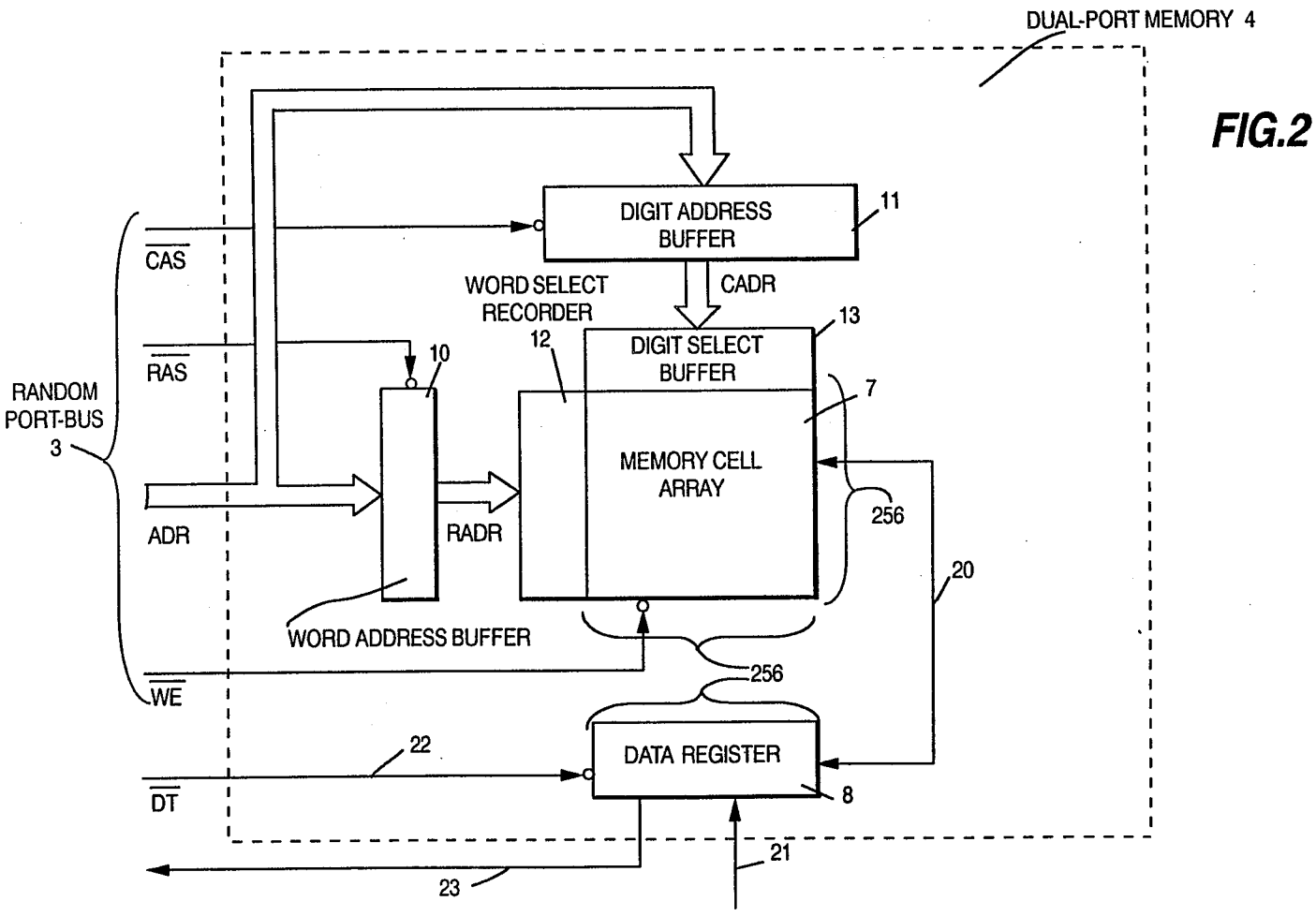
FIG. 2 is a block diagram of the system configuration of the dual-port memory in FIG. 1.

FIG. 1 is a block diagram of a first embodiment of a picture processing apparatus according to the invention, and FIG. 2 is a block diagram of the system configuration of a dual-port memory in FIG. 1.

In FIG. 1, numeral 1 denotes a processor controlled in accordance with a control program stored in a ROM (not shown) or the like. A control signal from the processor 1 is delivered to a dual-port memory and to various other peripheral devices, not shown, via a system bus 2.

Numeral 3 denotes a random port bus connecting the system bus 2 with a random-access port of a picture memory comprising a dual-port memory 4 forming a frame buffer. The dual-port memory 4 comprises a random-access block 5 having a memory cell array 7, and a serial-access block 6 having a data register 8 in which one row of paint information of the memory cell array 7 is stored.

The random-access block 5 is randomly accessed by the processor 1 via the system bus 2 and random port bus 3. The memory cell array 7 is formed by a RAM capable of storing, e.g., 256×256 pixels of data.

The serial-access block 6 has its serial port connected to the processor 1 by a serial port bus 22 and is accessed serially by the processor. The data register 8 is formed by a shift register which forms, e.g., one row of data of memory cell array 7, i.e., one pixel of pixel data of eight bits, and which stores 56 pixels of data in a manner capable of serial input and output. The data register is connected to the memory cell array 7 via a data line 20 and is capable of input and output.

Storage means 9 is formed by, e.g., an eight-bit register and stores predetermined paint information for painting the memory cell array 7 of dual-port memory 4 in one color. The paint information is, e.g., display screen luminanace information or display screen color discrimination information. If the storage means is composed of an eight-bit register, then the luminance of 256 tones or 256 colors can be specified. The storage means is connected to the data register 8 of the dual-port memory 4 via a data line 21. The storage of paint information is completed with one access by the processor 1 via a control line 25. At this time, the eight-bit paint information is applied via a data bus 24.

The data register 8 is constructed as set forth above. Accordingly, as for the paint information stored in the storage means 9, one row of the memory cell array 7 is stored in the data register 8 by 256 shifts performed by a microprogram control unit of a bit slice. An internal transfer of paint information from the data register 8 to the memory cell array 7 is performed after one row of paint information is stored in the data register 8.

The dual-port memory 4 of this embodiment outputs data stored in the memory cell array 7, e.g., picture information, to the system bus 2 in serial form via the data register 8 and an output line 23. The data can be displayed in the form of a picture on a CRT display.

The construction of the dual-port memory 4 is shown in detail in FIG. 2.

Addressing of the random-access block 5 of dual-port memory 4 is performed by well-known address multiplexing. More specifically, the processor 1 transmits a digit select strobe signal $\overline{CAS}$, a word select strobe signal $\overline{RAS}$, a write-enable signal ,ovs/WE/ , and an address signal ADR to the random-access block 5. The address signal ADR is stored in a word address buffer 10 and a digit address buffer 11. The buffers 10, 11 are divided between the word address signal RADR and digit address signal CADR, which are staggered with respect to each other in terms of timing, under the control of the word select strobe signal $\overline{RAS}$ and digit select strobe signal $\overline{CAS}$. The word address signal RADR output by the buffer 10 is applied to a word select decoder 12, where the signal is decoded to designate a specific row of the memory cell array 7. Meanwhile, the digit address signal CADR output by the buffer 11 is applied to the digit select decoder 13, where the signal is decoded to designate a specific column of the memory cell array 7.

Thus, a specific row and column can be designated by address signal ADR, word select strobe signal $\overline{RAS}$ and digit select strobe signal $\overline{CAS}$ from processor 1.

The write-enable signal WE from the processor 1 is applied to the memory cell array 7. When the signal $\overline{WE}$ is "L", a write-enable state is established; when $\overline{WE}$ is "H", a read-enable state is established. Accordingly, the writing of one row of data into the memory cell array 7, namely the internal transfer from the data register 8, is performed by specifying the row of the memory cell array 7 into which the data are to be written and setting the write-enable signal $\overline{WE}$ to "L" based on the address signal ADR and word select strobe signal $\overline{RAS}$. As for the data to be written at this time, namely the identical paint information, one row of the memory cell array 7 has already been written in the data register 8. When a data transfer signal $\overline{DT}$ assumes the "L" level, one row of paint information stored in the data register 8 is fetched one pixel at a time in serial fashion and the information is written serially into predetermined column positions of a predetermined row of the memory cell array 7 via the data line 20.

Accordingly, the one row of identical paint information stored in the data register 8 by the 256 shift operations performed by the microprogram control unit is internally transferred in its entirety to a predetermined row of the memory cell array 7 serially one pixel at a time in response to a single generation of the data transfer signal $\overline{DT}$ by the processor 1, namely by a single access from the processor 1. The identical paint information can be stored over one predetermined row of the memory cell array 7.

In order to perform the internal transfer to the memory cell array 7 reliably, the write-enable signal $\overline{WE}$ must be "L" at the same time that data transfer signal $\overline{DT}$ is "L".

It will readily be understood from the foregoing that in order for the identical paint information to be stored over all rows of the memory cell array 7, it will suffice if the processor 1 transmits the data transfer signal $\overline{DT}$ 256 times at a predetermined timing, so that accessing is performed only 256 times. Further, since the transfer of one row of data to the memory cell array 7 is a transfer performed entirely internally of the dual-port memory 4, the transfer can be performed in a very short period of time in comparison with the conventional apparatus in which the processor 1 is required to perform an access one pixel at a time.

Painting in accordance with the invention with regard to a picture memory will now be described with reference to FIG. 3.

Figure 3:
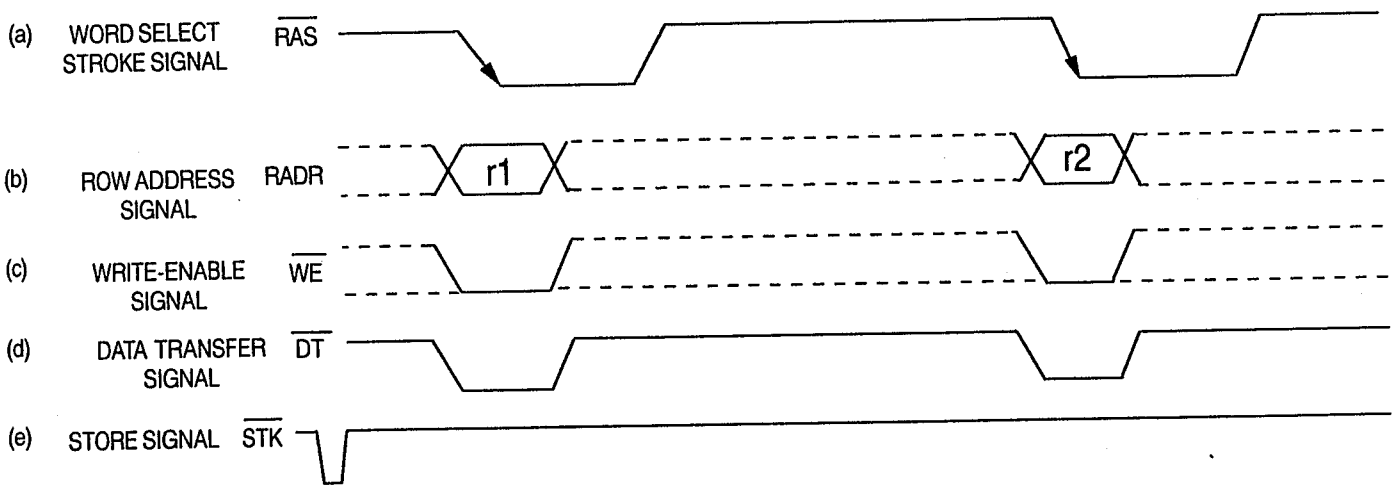
FIG. 3 is a timing diagram of picture processing for FIG. 1.

Before data are written into the memory cell array 7, the processor 1 transmits a storage signal $\overline{STK}$ to the storage means 9 via the control line 25 at the timing shown in FIG. 3(*e*) in order to store eight bits of paint information in the storage means 9. When the storage signal $\overline{STK}$ is "L", eight-bit paint information is stored in its entirety in the storage means 9 via the data bus 2 and data bus 24.

Next, in order to store 256 pixels of paint information in the data register 8 of dual-port memory 4, the paint information just stored in the storage means 9 is shifted serially 256 times into the data register 8 (256 pixels of data are stored). The shift-in operation is performed at high speed by the microprogram control unit of the bit slice, as mentioned above. As for the timing, the shift-in must be performed after the storage signal $\overline{STK}$ is output but before the data transfer signal $\overline{DT}$ shown in FIG. 3(*d*) is output, though this is not shown in FIG. 3.

Next, in order to internally transfer the 256 pixels of identical write information stored in the data register 8 to the predetermined row of the memory cell array 7 of dual-port memory 4 (i.e. in order to accommodate the 256 pixels of information), first the write-enable signal WE applied to the memory cell array 7 is set to "L", as shown in FIGS. 3(*c*), (*d*), and at the same time, the data transfer signal $\overline{DT}$ applied to the data register 8 is set to "L". In order to paint the first row of the memory cell array 7 at the beginning of the operation, the processor 1 sends the address signal ADR for the first row via the system bus 2 and random port bus 3. The address signal ADR is temporarily stored in the word address buffer 10 and, as shown in FIGS. 3(*a*), (*b*), is transmitted to the word select decoder 12 as the row address signal RADR at the negative-going transition of the word select strobe signal RAS. At this time the address value of the row address signal RADR is $r_1$, which designates the first row. In response to these control signals $\overline{WE}$, $\overline{DT}$, $r_1$, the 256 pixels of identical paint information in data register 8 are internally transferred to the first row of the memory cell array 7 via the data line 20.

During the internal transfer of the 256 pixels of paint information, the processor 1 need not access the dual-port memory 4 each time. That is, the processor 1 need access the dual-port memory 4 only once in order to store one row of paint information in the memory cell array 7. Since it is unnecessary to perform an access 256 times from the random port bus 3, as in the prior art, processing speed can be markedly improved.

In order to store identical paint information in the second row after identical paint information is stored in the first row, the write-enable signal $\overline{WE}$ and data transfer signal $\overline{DT}$ are set to "L" simultaneously, as shown in FIGS. 3(*c*), (*d*), just as in storing the first row, and the row address signal RADR is set to an address value $r_2$ for the second row. As a result, 256 pixels of identical paint information in data register 8 are internally transferred to the second row of the memory cell array 7 via the data line 20. Thereafter, and in similar fashion, all identical paint information can be stored in the memory cell array 7 up to the 256 -th row.

Figure 4:
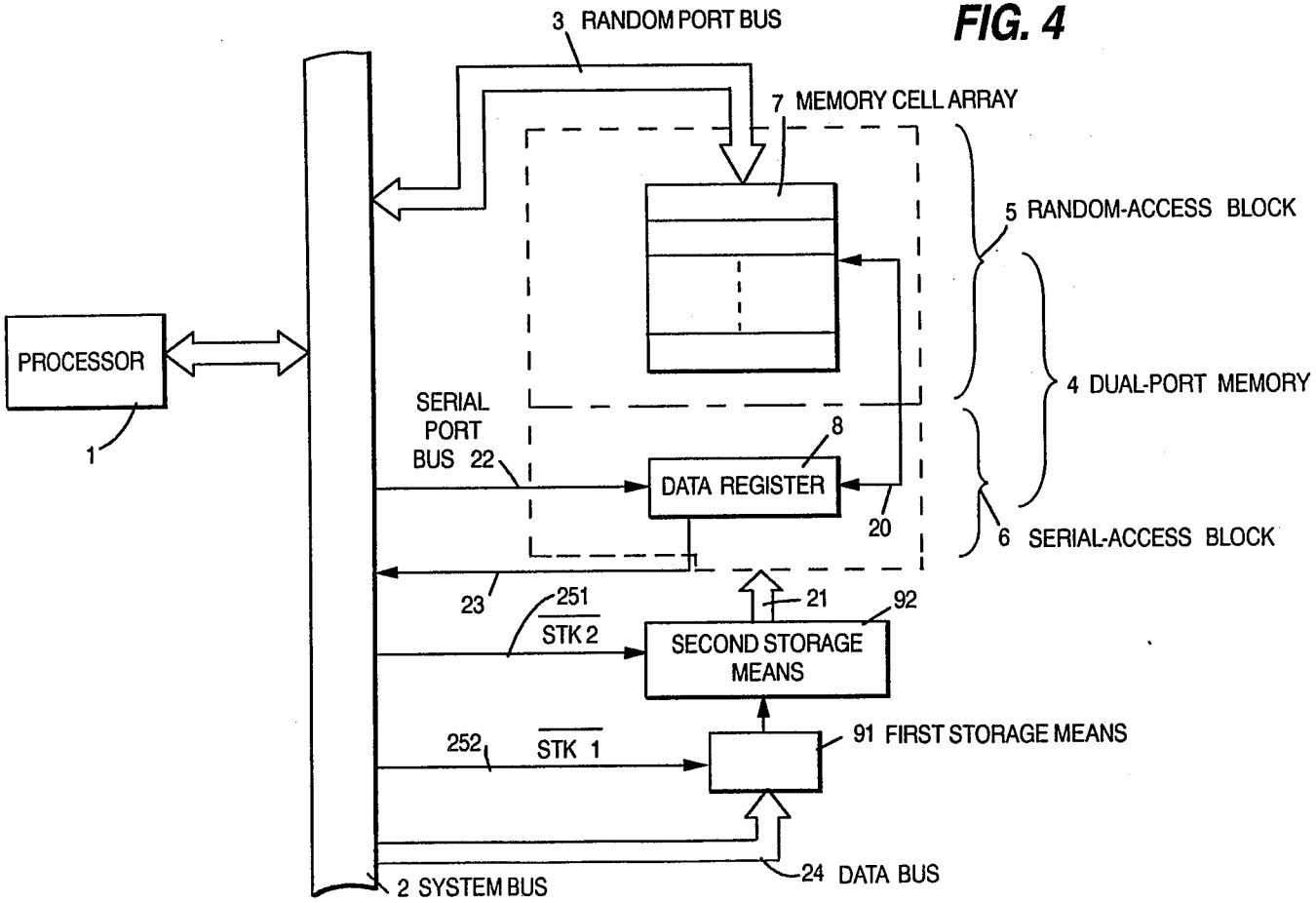
FIG. 4 is a block diagram of a second embodiment of a picture processing apparatus according to the invention.

FIG. 4 is a block diagram of a second embodiment of a picture processing apparatus according to the invention. Only those points that differ from the first embodiment will be described.

A first storage means 91 is composed of e.g. an eight-bit register. A second storage means 92 is formed by , e.g., a shift register which forms one row of data of memory cell array 7, i.e., one pixel of pixel data of eight bits, and which stores 256 pixels of data in a manner capable of serial input and output. The second storage means stores predetermined paint information for painting the memory cell array 7 of the dual-port memory 4 in row units with a predetermined gradation. The paint information is e.g. display screen luminanace information or display screen color discrimination information. If the storage means is composed of an eight-bit register, then the luminance of 256 tones or 256 colors can be specified. The second storage means 92 is connected to the data register 8 of the dual-port memory 4 in bit-to-bit correspondence by a data line 21' capable of a parallel/serial transfer. The storage of paint information is completed with one access by the processor 1 via a control line 251. The eight-bit paint information is stored beforehand in the second storage means 92 from the first storage means 91 through 256 shift operations performed by the microprogram control unit via the data bus 24.

The data register 8 has the same construction as in the first embodiment. As for the paint information stored in the second storage means 92, one row of the memory cell array 7 is transferred collectively to the data register 8. The internal transfer of paint information from the data register 8 to the memory cell array 7 is performed after one row of paint information is stored in the data register 8.

Completely identical paint information can be stored up to the 256 -th row of the memory cell array 7 in a similar manner. Accordingly, when 256 rows of the paint information are stored, the processor 1 first accesses the first storage means 91 256 times via the control line 252. After one row of paint information is stored in the second storage means 92, it will suffice to access the second storage means 92, the data register 8 and the memory cell array 7 for 256 rows, i.e., 256 times. Thus, it is not longer necessary to perform access 256×256 times, as in the prior-art apparatus.

Thus, in accordance with the picture processing apparatus as set forth above, it is possible to greatly reduce the number of times the processor accesses the dual-port memory in order to store entirely identical paint information or paint information with a predetermined gradation in row units in the memory cell array of the dual-port memory. This makes it possible to lighten the burden on the processor and to greatly shorten the time required for the paint information to be stored in the memory cell array. Accordingly, the invention is well-suited for use in picture processing in a display unit, especially a CRT display unit connected to a numerical controller controlling a machine tool or the like.

We claim:

1. A picture processing apparatus having a picture memory and including a processor, comprising:

a dual-port memory connected to the processor by way of a serial port and a random port, said dual port memory comprising:

a memory cell array, having rows, randomly accessed by the processor by way of the random port for storing predetermined pixel information; and a data register, having a serial input function, accessed by way of the serial port and adapted to transfer predetermined paint information to said memory cell array; and storage means, accessed by the processor, for storing paint information to be transferred to said data register.

2. A picture processing apparatus according to claim 1, wherein said data register internally transfers one row of paint information stored therein to a predetermined one of said rows in said memory cell array.

3. A picture processing apparatus according to claim 2, wherein said paint information is picture color discrimination information.

4. A picture processing apparatus according to claim 2, wherein said paint information is picture luminance information.

5. A picture processing apparatus according to claim 2, wherein said storage means comprises:

first storage means accessed from the processor in single pixel units of said paint information; and second storage means connected to said data register in bit-to-bit correspondence for performing a parallel/serial transfer.

6. A picture processing apparatus according to claim 5, wherein said paint information is picture luminance information.

7. A picture processing apparatus according to claim 5, wherein said paint information is picture color discrimination information.

8. A picture processing apparatus according to claim 1, wherein said storage means comprises a register and wherein paint information stored in said register is stored by a single access from the processor.

9. A picture processing apparatus according to claim 8, wherein said paint information is picture luminance information.

10. A picture processing apparatus according to claim 8, wherein said paint information is picture color discrimination information.

11. A picture processing apparatus according to claim 8, wherein said storage means comprises:

first storage means accessed from the processor in single pixel units of said paint information; and second storage means connected to said data register in bit-to-bit correspondence for performing a parallel/serial transfer.

12. A picture processing apparatus according to claim 11, wherein said paint information is picture luminance information.

13. A picture processing apparatus according to claim 11, wherein said paint information is picture color discrimination information.

14. A picture processing apparatus according to claim 1, wherein said storage means comprises:

first storage means accessed by the processor in single pixel units of said paint information; and second storage means connected to said data register in bit-to-bit correspondence for performing a parallel/serial transfer.

15. A picture processing apparatus according to claim 14, wherein said paint information is picture luminance information.

16. A picture processing apparatus according to claim 14, wherein said paint information is picture color discrimination information.

17. A picture processing apparatus according to claim 1, wherein said paint information is picture luminance information.

18. A picture processing apparatus according to claim 1, wherein said paint information is picture color discrimination information.

19. A picture processing apparatus including a processor, and having a dual port memory forming a frame buffer, comprising:

a random access block including a memory cell array being randomly accessed by the processor;

a serial access block including a data register and having a serial port connected to the processor;

storage means, connected to the processor, for storing predetermined paint information for painting said memory cell array, one row of said memory cell being stored in said data register, a transfer of paint information from said data register to said memory cell array being performed after storing paint information in said data register.

* * * * *

UNITED STATES PATENT AND TRADEMARK OFFICE

CERTIFICATE OF CORRECTION

PATENT NO. : 4,890,100

DATED : DECEMBER 26, 1989

INVENTOR(S) : MITSUO KURAKAKE ET AL.

It is certified that error appears in the above-identified patent and that said Letters Patent is hereby corrected as shown below:

Col. 2, line 49, "56" should be --256--.

Col. 3, line 17, ",ovs/WE/," should be --$\overline{\text{WE}}$,--.

Signed and Sealed this

Twenty-third Day of October, 1990

*Attest:*

HARRY F. MANBECK, JR.

*Attesting Officer*

*Commissioner of Patents and Trademarks*